United States Patent [19]

Ishii et al.

[11] 4,396,706

[45] Aug. 2, 1983

[54] SILVER HALIDE PHOTOGRAPHIC LIGHT-SENSITIVE MATERIAL AND IMAGE FORMING METHOD

[75] Inventors: Tsumoru Ishii; Shinji Sakaguchi, both of Minami-ashigara, Japan

[73] Assignee: Fuji Photo Film Co., Ltd., Kanagawa, Japan

[21] Appl. No.: 279,401

[22] Filed: Jul. 1, 1981

[30] Foreign Application Priority Data

Jul. 1, 1980 [JP] Japan ..... 55-89863

[51] Int. Cl.[3] ..... G03C 5/26

[52] U.S. Cl. ..... 430/403; 430/434; 430/523; 430/536; 430/950; 430/961

[58] Field of Search ..... 430/950, 961, 523, 536, 430/537, 434, 403

[56] References Cited

U.S. PATENT DOCUMENTS

| | | | |
|---|---|---|---|
| 3,079,257 | 2/1963 | Morcher et al. | 430/950 |
| 3,370,951 | 2/1968 | Hasenauer et al. | 430/950 |
| 3,632,342 | 1/1972 | Salesin et al. | 430/950 |
| 4,022,622 | 5/1977 | Timmerman et al. | 430/950 |
| 4,094,848 | 1/1978 | Naito | 430/950 |
| 4,142,894 | 3/1979 | Hori et al. | 430/950 |

*Primary Examiner*—Mary F. Downey
*Attorney, Agent, or Firm*—Sughrue, Mion, Zinn, Macpeak and Seas

[57] ABSTRACT

A silver halide photographic light-sensitive material is described containing in its outermost layer a high molecular weight matting agent formed from at least one kind of alkali insoluble synthetic polymer grains having a glass transition point of at least 60° C. and an average grain size of from 0.2 to 10, and said polymer is represented by the formula (I):

$$-(A)_x-(B)_y-(C)_z \qquad (I)$$

wherein A represents a divalent group derived from at least one monomer having the formula (II); B represents a divalent group derived from at least one monomer having the formula (III), whose homopolymer has a glass transition point of at least 50° C.; C represents a divalent group derived from an ethylenic unsaturated monomer other than A or B which is capable of copolymerizing with the monomers forming both A and B; x represents the fractional content of group A, which ranges from 0.005 to 0.20 mol/mol of polymer of formula (I); y represents the fractional content of group B, which ranges from 0.50 to 0.995 mol/mol of polymer of formula (I); and z represents the fractional content of group C, which ranges from 0 to 0.495 mol/mol of polymer of formula (I). Formula (II) and formula (III) are disclosed herein.

These polymer grains are not removed from the outermost layer by rapid development-processing and exhibit a satisfactory matting effect even after the completion of such processing.

21 Claims, No Drawings

SILVER HALIDE PHOTOGRAPHIC LIGHT-SENSITIVE MATERIAL AND IMAGE FORMING METHOD

FIELD OF THE INVENTION

This invention relates to a silver halide photographic light-sensitive material and, more particularly, to an image-forming method in which a silver halide photographic light-sensitive material (referred to simply as the "sensitive material" hereinafter) containing a high molecular weight matting agent in its outermost layer is employed.

BACKGROUND OF THE INVENTION

In general, a sensitive material has an outermost layer (surface layer) which contains as a binder a certain hydrophilic organic colloid whose representative is gelatin. Therefore, the sensitive material shows an increase in its adhesiveness or tackiness under circumstances of high temperature and humidity, whereby adhesion occurs readily when the sensitive material is allowed to stand in contact with another object.

This adhesion phenomenon occurs between sensitive materials, or between a sensitive material and a different material placed in contact therewith upon production of the sensitive material or during storage, photographing, processing or projection, or during preservation of the processed sensitive material, and it often causes serious disadvantages.

It is well-known in this art that in order to solve this problem an inorganic substance such as silicon dioxide, magnesium oxide, titanium dioxide, calcium carbonate or the like, or fine grains of an organic substance such as polymethyl methacrylate, cellulose acetate propionate or the like (which are called "matting agent" hereinafter) is incorporated in the topmost layer of a sensitive material and thereby the surface of the sensitive material is increased in its roughness, that is to say, it is matted and reduces its adhesiveness.

In some cases it is desired to remove a matting agent for the purposes of improving transparency and graininess properties of formed images. Such a method is described in U.S. Pat. No. 4,142,894, which describes methyl methacrylate-methacrylic acid copolymers intended to be soluble in an alkaline processing solution at a temperature above 30° C. On the other hand, in other photographic materials it is desired to retain the matting agent to prevent the adhesion phenomenon after developing, and to prevent removal of matting agent and related problems during image development processing.

On the other hand, recent development-processing techniques for sensitive materials have been increasingly rapid. In proportion, as the processing time becomes shorter, the sensitive material carries a larger amount of processing solution used in the previous processing step into the processing bath subsequent thereto and, consequently, the processability of the processing bath deteriorates more rapidly. In addition, an increased water content in the final processing bath imposes heavier load on the drying system, and, consequently, makes a rapid processing more difficult.

Under these circumstances, various devices have been tried with the intention of reducing the quantity of a processing solution which is carried out of the processing bath used in one step into another processing bath to be used in the following step.

For instance, in the case that a number of narrow belt-form films, such as color sensitive materials having a width of 35 mm, are linked up one after another, and subjected continuously to a chain of processings, a rubber plate for removing excess liquid (which is referred to as a "rubber lip" hereinafter) has been set up between each pair of processing baths arranged in order and/or behind the last processing bath, and the sensitive materials are drawn through the rubber lips and thereby the processing solutions adhering to the sensitive material are scraped off respectively. In another case that sheet-form sensitive materials, such as X-ray sensitive materials, are processed, a pair of counter rollers is set up between every pair of processing baths arranged in order and/or behind the last processing bath, and the sensitive materials are drawn through pairs of rollers and thereby the processing solutions adhering to the sensitive material are squeezed respectively. Rollers used for this purpose are called "squeeze rollers". Furthermore, "buff rollers" can be also used to remove excess processing solutions from the sensitive materials.

Thus, as a chain of processings of sensitive materials is carried out at higher speed, the extent of damage from abrasion which is caused in the surface of a sensitive material by the sensitive material being passed through the rubber lips, the squeeze rollers or the buff rollers becomes more drastic.

When the surface of a sensitive material is rubbed severely with rubber lips, squeeze rollers or buff rollers, problems such that matting agent present in the outermost layer is removed from the layer are apt to be caused.

Removal of the matting agent due to passage through rubber lips or squeeze rollers results in a low degree of matting for the sensitive material after the completion of a chain of processings, and tends to cause adhesion between sensitive materials or between the sensitive material and other materials and thereby causing various problems. Furthermore, upon contact exposure of another unexposed sensitive material through the sensitive material having received processings in the above-described manner there is a possibility of generation of the so-called "Newton ring" due to a low degree of matting (the extent of matting is expressed in the term of "mat property" hereinafter).

More importantly, removed particles of the matting agent are accumulated, aggregate, grow into huge grains, and some of resulting huge grains of the matting agent are transferred onto the surfaces of other sensitive materials.

Adhesion of such huge grains to the surfaces of sensitive materials makes the sensitive materials dirty and causes severe damage to the quality of the sensitive materials finished processings.

Furthermore, the huge grains of a matting agent accumulated on the surface of a rubber lip or a squeeze roller impair the surface of a sensitive material conveyed with a high speed, and in some cases may make scratches on the surface of the sensitive material.

A scratch having once been generated, a lot of defective materials are produced for a short time because of high processing and conveying speeds, to result in a heavy loss.

In addition, although fine grains of silicon dioxide have generally been employed as a matting agent in this art, such a matting agent suffer from the defect that it is impossible to control their average grain size to the degree desired.

Moreover, fine grains of silicon dioxide are likely to adhere to wall surfaces of a dissolution tank and so on in the step of preparing a coating solution for making a hydrophilic colloidal layer of a sensitive material, for example, a surface protecting layer and, therefore, they suffer from a troublesome disadvantage that the cleaning work in the preparation step requires extensive labor.

SUMMARY OF THE INVENTION

Therefore, an object of this invention is to provide a sensitive material which exhibits a satisfactory mat property even after the completion of development-processing without causing removal of a matting agent in the processing step, even in the rapid development-processing step.

Another object of this invention is to provide a sensitive material in which a matting agent is used whose grain size may be easily controlled, and whose grains do not firmly stick on wall surfaces of a dissolution tank and the like in the step of producing the sensitive material.

The above-described objects of this invention are attained with a sensitive material which has on a support at least one light-sensitive silver halide emulsion layer, said material containing in its outermost layer at least one kind of alkali insoluble synthetic polymer grains having a glass transition point of at least 60° C. and an average grain size of 0.2μ to 10μ, and said polymer is represented by formula (I):

$$-A)_x(B)_y(C)_z \qquad (I)$$

wherein A represents a divalent group derived from at least one monomer having the formula (II) (illustrated below); B represents a divalent group derived from at least one monomer having the formula (III) (illustrated below) whose homopolymer has a glass transition point of 50° C. or higher; C represents a divalent group derived from an ethylenic unsaturated monomer which is capable of copolymerizing with the monomers forming both A and B; x represents the fractional content of group A, which ranges from 0.005 to 0.20 mol/mol of polymer of formula (I); y represents the fractional content of group B, which ranges from 0.50 to 0.995 mol/mol of polymer of formula (I); and z represents the fractional content of group C, which ranges from 0 to 0.495 mol/mol of polymer of formula (I).

Formula (II) is represented by

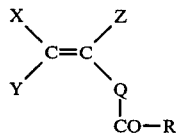

(II)

wherein X, Y and Z each represents hydrogen, an alkyl group having from 1 to 6 carbon atoms, —COR or —$COOR_1$; Q represents

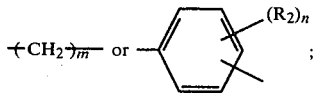

and R represents

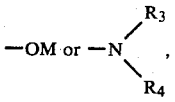

where $R_1$ represents a substituted or an unsubstituted alkyl group having from 1 to 18 carbon atoms, an aryl group having from 6 to 18 carbon atoms, or an aralkyl group having from 7 to 12 carbon atoms; $R_2$ represents hydrogen, a halogen atom, an alkyl group having from 1 to 12 carbon atoms, or an alkoxy group having from 1 to 6 carbon atoms; $R_3$ represents hydrogen, a substituted or an unsubstituted alkyl group having from 1 to 4 carbon atoms, a phenyl group or an aralkyl group having from 7 to 10 carbon atoms; $R_4$ represents the same groups as $R_3$ or an —$R_5$—CONH)$_l$$R_5COR_7$ group; $R_5$ represents a divalent aliphatic or an aromatic group having 1 to 12 carbon atoms, $R_7$ represents —OM, hydrogen, a substituted or an unsubstituted alkyl group ($C_1$–$C_4$), a phenyl group or an aralkyl group ($C_7$–$C_{10}$), and l is an integer of 0 to 6; M represents hydrogen or a cation (e.g., an alkali metal atom, an ammonium group, etc.); m is 0 or 1; and n is an integer of 1 to 4.

Formula (III) is represented by

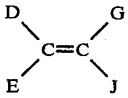

(III)

wherein D and E each represents hydrogen, a methyl group, a halogen atom or —$COOR_6$; G represents hydrogen, a methyl group, a halogen atom or —$(CH_2)_k$—$COOR_6$; J represents hydrogen, an aryl group,

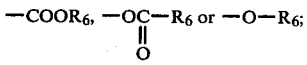

$R_6$ represents a substituted or an unsubstituted alkyl group having from 1 to 10 carbon atoms, an aryl group having from 6 to 12 carbon atoms or an aralkyl group having from 7 to 12 carbon atoms; and k is 0 or 1.

In another aspect, the present invention relates to a method of forming images comprising imagewise exposing and development-processing a silver halide photographic light-sensitive film material, as described above, wherein the development-processing is carried out using a squeezing means (for example, a rubber lips, squeeze rollers and buff rollers) for removing excess liquid from the film material.

DETAILED DESCRIPTION OF THE INVENTION

Examples of substituent group which may be present on the alkyl groups, aryl groups and aralkyl groups represented by $R_1$ or $R_6$ include a halogen atom (e.g., Cl, Br and F), a cyano group, an alkoxy group having from 1 to 8 carbon atoms, a hydroxy group, a phenoxy group, a dialkylamino group having from 1 to 6 carbon atoms, a furfuryl group, a tetrahydrofurfuryl group, an acyl group having from 1 to 8 carbon atoms, an acyloxy group having from 1 to 8 carbon atoms, a carboalkoxy group having from 1 to 12 carbon atoms, and so on.

Examples of monomers represented by the formula (II) include acrylic acid, methacrylic acid, maleic acid, monoalkyl maleates (e.g., monomethyl maleate, monoethyl maleate, monobutyl maleate, monooctyl maleate, monophenyl maleate, etc.), itaconic acid, monoalkyl itaconates (e.g., monomethyl itaconate, monoethyl itaconate, monooctyl itaconate, etc.), fumaric acid, monoalkyl fumarates (e.g., monomethyl fumarate, monoethyl fumarate, etc.), crotonic acid, methylenemalonic acid, monoalkyl ethylenemalonates (e.g., monomethyl methylenemalonate, monoethyl methylenemalonate, monohexyl methylenemalonate, etc.), citraconic acid, α,β-dimethylmaleate, N-(meth)acryloylamino acids (e.g., N-acryloylglycine, N-methacryloylglycine, N-acryloylglycylglycine, N-methacryloylglycylglycine, N-methacryloylglycylglycylglycine, N-acryloylalanine, N-methacryloylalanine, N-methacryloylalanylalanine, N-acryloylvaline, N-methacryloylleucine, N-methacryloylisoleucine, N-acryloylproline, N-acryloyl-β-aminopropionic acid and N-methacryloyl-β-aminopropionic acid), vinylbenzoic acid, acrylamide, N-methylacrylamide, N-hydroxymethylacrylamide, N,N-dimethylacrylamide, N-methoxymethylacrylamide, N-t-butylacrylamide, N,N-diethylacrylamide, methacrylamide, N,N-dimethylmethacrylamide, N,N-diethylmethacrylamide, N-acryloylpiperidine, N-acryloylpyrrolidine, N-methacryloylmorpholine, N-methacryloylpiperidine, maleic acid monoamide, N-alkylmaleic acid monoamides (e.g., N-ethylmaleic monoamide, N-butylmaleic acid monoamide, etc.), itaconic acid monoamide, N-alkylitaconic acid monoamide (e.g., N-ethylitaconic acid monoamide, N-butylitaconic acid monoamide, etc.), methylenemalonic acid monoamide, N-alkylmethylenemalonic acid monoamides (e.g., N-ethylmethylenemalonic acid monoamide, N-hexylmethylenemalonic acid monoamide, etc.), N,N-dialkylmaleic acid monoamides (e.g., N,N-diethylmaleic acid monoamide, N,N-dibutylmaleic acid monoamide, etc.), N,N-dialkylitaconic acid monoamides (e.g., N,N-diethylitaconic acid monoamide, N,N-dibutylitaconic acid monoamide, etc.) and so on. Therein, the acids may take the form of salt by combining with alkali metals like Na and K, or with ammonium ion.

Examples of monomers represented by the formula (III) include acrylic acid esters, methacrylic acid esters, styrenes, vinyl esters, vinyl ethers, olefins, unsaturated nitriles and so on. These monomers may be employed as the component B in the formula (I), provided that their homopolymers have glass transition points of at least 50° C.

Specific examples of monomers represented by formula (III) whose homopolymers have a glass transition point of at least 50° C. include t-butyl acrylate, isobornyl acrylate, phenyl acrylate, p-chlorophenyl acrylate, methyl methacrylate, ethyl methacrylate, isopropyl methacrylate, t-butyl methacrylate, cyclohexyl methacrylate, cyanoethyl methacrylate, chloroethyl methacrylate, bromoethyl methacrylate, phenyl methacrylate, p-chlorophenyl methacrylate, p-cyanophenyl methacrylate, p-carbomethoxyphenyl methacrylate, p-cyanoethylphenyl methacrylate, adamantyl methacrylate, tetrahydrofurfuryl methacrylate, furfuryl methacrylate, isobornyl methacrylate, styrene, methylstyrene, α-methylstyrene, dimethylstyrene, trimethylstyrene, ethylstyrene, isopropylstyrene, benzylstyrene, chloromethylstyrene, trifluoromethylstyrene, ethoxymethylstyrene, methoxystyrene, chlorostyrene, dichlorostyrene, bromostyrene, fluorostyrene, methyl vinylbenzoate, vinylphenyl acetate, vinyl benzoate, vinyl chlorobenzoate, vinyl naphthoate, t-butyl vinyl ether, isopropyl vinyl ether, isobutyl vinyl ether, phenyl vinyl ether, acrylonitrile, methacrylonitrile, vinyl chloride and so on.

C represents a divalent group derived from an ethylenic unsaturated monomer other than A or B which is capable of copolymerizing with the monomers forming both A and B. For example, acrylic acid esters, methacrylic acid esters, acrylamides, methacrylamides, vinyl esters, vinyl ketones, allyl compounds, olefins, vinyl ethers, N-vinylamides, vinyl heterocyclic compounds, maleic acid esters, itaconic acid esters, fumaric acid esters, crotonic acid esters and so on may be employed as the component C. Specific examples include methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octylacrylate, tert-octyl acrylate, 4-chlorobutyl acrylate, cyanoethyl acrylate, dimethylaminoethyl acrylate, cyclohexyl acrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethylene glycol monoacrylate, triethylene glycol monoacrylate, dipropylene glycol monoacrylate, glycerol monoacrylate, trimethylolethane monoacrylate, trimethylolpropane monoacrylate, pentaerythritol monoacrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate (the addition mol number of ethylene oxide groups, "n", is 9 in the formula

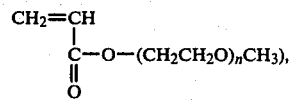

$$CH_2{=}CH-C(=O)-O-(CH_2CH_2O)_nCH_3),$$

ω-lauroxypolyethylene glycol acrylate (addition mol number n=20), 1-bromo-2-methoxyethyl acrylate, 1,1-dichloro-2-ethoxyethyl acrylate, 2-hydroxy-3-chloropropyl acrylate, amyl methacrylate, hexyl methacrylate, octyl methacrylate, sulfopropyl methacrylate, N,N-diethylaminopropyl methacrylate, 2-hydroxyethyl methacrylate, 3-hydroxypropyl methacrylate, 2-hydroxypropyl methacrylate, 2,3-dihydroxypropyl methacrylate, 4-hydroxybutyl methacrylate, 5-hydroxypentyl methacrylate, 2,2-dimethyl-3-hydroxypropyl methacrylate, diethylene glycol monomethacrylate, triethylene glycol monomethacrylate, dipropylene glycol monomethacrylate, glycerol monomethacrylate, trimethylolethane monomethacrylate, trimethylolpropane monomethacrylate, pentaerythritol monomethacrylate, 2-methoxyethyl methacrylate, 3-methoxybutyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (addition mol number n=6), ω-methoxypolyethylene glycol methacrylate (addition mol number n=23), ω-lauroxypolyethylene glycol methacrylate, hexyl acrylamide, octyl acrylamide, 2-acrylamido-2-methylpropanesulfonic acid, N-(1,1-dimethyl-3-oxobutyl)acrylamide, pentyl methacrylamide, dihexyl methacrylamide, allyl caproate, allyl caprate, allyl laurate, allyl palmitate, allyl stearate, allyl acetoacetate, allyl butyrate, allyloxyethanol, allyl butyl ether, hexyl vinyl ether, octyl vinyl ether, decyl vinyl ether, ethylhexyl vinyl ether, methoxyethyl vinyl ether, ethoxyethyl vinyl ether, 2-ethylbutyl vinyl ether, hydroxyethyl vinyl ether, diethylene glycol vinyl ether, dimethylaminoethyl vinyl ether, vinyl formate, vinyl acetate, vinyl propionate, vinyl butyrate, vinyl isobutyrate, vinylethyl butyrate, vinyl valerate, vinyl caproate, vinyl methoxyacetate, vinyl butoxyacetate, vinyl acetoacetate, vinyl lactate, N-vinyloxazolidone, vinylpyridine, vinylpicoline, N-vinylimidazole, N-vinyl-2-methylimidazole, N-vinyltriazole, N-vinyl-3,5-dimethyltriazole, N-vinylpyrrolidone, N-vinyl-3,5-dimethylpyrazole, N-vinylcarbazole, vinylthiophene, N-vinylsuccinimide, N-vinylglutarimide, N-vinyladipimide, N-methyl-N-vinylformamide, N-ethyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-s-caprolactam, N-vinyl-2-pyridone, vinyl methyl ketone, methoxyethyl vinyl ketone, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,5,6-trimethyl-1-heptene, 1-dodecene, 1-octadecene, dioctyl itaconate, dihexyl itaconate, dibutyl itaconate, maleic anhydride, dihexyl maleate, butyl hexyl maleate, dibutyl maleate, dioctyl maleate, dibutyl fumarate, dioctyl fumarate and so on.

Of these monomers, monomers of the formula (II) wherein X, Y and Z each represents hydrogen, $—CH_3$ or —COR, and Q represents $—CH_2—_m$ are more preferably employed from the viewpoints of the solubilities of the polymers prepared therefrom, the transparencies thereof, the oleophilicities thereof, the hydrophilicities thereof, the affinity thereof for protective colloids (to prevent removal of matting agent from protective colloids, for example, gelatin), the facilities in polymerizations and so on. Particularly, acrylic acid, methacrylic acid, maleic acid, itaconic acid and (meth)acryloylamino acid are preferred therefor. On the other hand, as monomers represented by the formula (III), monomers wherein D and E each represents hydrogen and G represents a methyl group are preferred. Of such monomers, methacrylic acid esters and styrenes are particularly preferable.

In the composition of the polymers of this invention having the formula (I), as the fraction x becomes smaller, the affinity for hydrophilic protective colloids, such as gelatin, becomes weaker. On the other hand, if the fraction x becomes too large, the polymer grains of this invention dissolve in processing solutions for silver halide photographic light-sensitive materials, whereby various disadvantages are caused. Accordingly, the range of x is from 0.005 to 0.20 mol, preferably from 0.01 to 0.18 mol, more preferably from 0.03 to 0.15 mol, and most preferably from 0.03 to less than 0.10 mol, per mol of polymer of formula (I).

Synthesis of these copolymers having repeating units as represented by the formula (I) can be advantageously carried out by reference to the methods as described in British Pat. No. 1,211,039, Japanese Patent Publication No. 29195/72, Japanese Patent Applications Nos. 7174/72, 23466/72, 59743/72 and 31355/73, British Pat. No. 961,395, U.S. Pat. Nos. 3,227,672, 3,290,417, 3,262,919, 3,245,932, 2,681,897 and 3,230,275, John C. Petropoulos et al., *Official Digest*, Vol. 33, pp. 719–736 (1961), Shunsuke Murahashi et al., Ed., *Gosei Kobunshi* (Synthetic Polymers), Vol. 1, pp. 246–290, and Vol. 3, pp. 1–108, published by Asakura Shoten (1971), and so on. Therein, the polymerization initiator, the concentration, the polymerization temperature, the reaction time and so on can be conveniently varied over a wide range depending upon the end-use purpose.

For instance, polymerization is carried out at a temperature ranging generally from 20° C. to 180° C., and preferably from 40° C. to 120° C. A polymerization reaction is, in general, effected using a radical polymerization initiator in a proportion of from 0.05 to 5 wt% of monomer to be polymerized. As examples of the initiator, mention may be made of azobis compounds, peroxides, hydroperoxides, redox catalysts and the like. More specifically, they include potassium persulfate, tert-butylperoctoate, benzoyl peroxide, isopropyl percarbonate, 2,4-dichlorobenzoyl peroxide, methyl ethyl ketone peroxide, cumene hydroperoxide, dicumyl peroxide, azobisisobutylonitrile and so on.

Molecular weights of polymers to be employed for the purpose of this invention are generally greater than about 3,000, and preferably they range from 10,000 to 1,000,000 or so. However, these values are not intended to be construed as suggesting critical values for attaining the effects of this invention.

Examples of typical copolymers represented by formula (I) are hereinafter described:

(1) Acrylic acid-ethyl methacrylate copolymer (mol ratio 5/95)
(2) Acrylic acid-ethyl methacrylate copolymer (mol ratio 10/90)
(3) Acrylic acid-ethyl methacrylate copolymer (mol ratio 15/85)
(4) Methacrylic acid-ethyl methacrylate copolymer (mol ratio 18/82)
(5) Methacrylic acid-methyl methacrylate copolymer (mol ratio 10/90)
(6) Methacrylic acid-methyl methacrylate copolymer (mol ratio 15/85)
(7) Methacrylic acid-methyl methacrylate copolymer (mol ratio 5/95)
(8) Itaconic acid-styrene copolymer (mol ratio 5/95)
(9) Maleic acid-methyl methacrylate copolymer (mol ratio 7/93)
(10) Methacrylic acid-t-butyl acrylate copolymer (mol ratio 16:84)
(11) Acrylic acid-phenyl acrylate copolymer (mol ratio 12/88)
(12) N—Acryloylglycine-t-butyl methacrylate copolymer (mol ratio 20/80)
(13) N—Methacryloylglycine-ethyl methacrylate copolymer (mol ratio 14/86)
(14) Itaconic acid-methyl methacrylate copolymer (mol ratio 8/92)
(15) Maleic acid-styrene copolymer (mol ratio 15/85)
(16) Acrylic acid-i-propyl methacrylate copolymer (mol ratio 13/87)
(17) Acrylic acid-benzyl methacrylate copolymer (mol ratio 8/92)
(18) Acrylic acid-p-chlorophenyl methacrylate copolymer (mol ratio 11/89)
(19) Methacrylic acid-vinyltoluene copolymer (mol ratio 13/87)
(20) Methacrylic acid-n-propyl methacrylate copolymer (mol ratio 9/91)
(21) Fumaric acid-styrene copolymer (mol ratio 6/94)
(22) Acrylic acid-ethyl methacrylate-N—vinylpyrrolidone copolymer (mol ratio 7/85/8)
(23) Acrylic acid-methacrylic acid-ethyl methacrylate copolymer (mol ratio 5/8/87)

-continued

| | |
|---|---|
| (24) | Acrylic acid-methyl methacrylate-n-propyl methacrylate copolymer (mol ratio 12/56/32) |
| (25) | Methacrylic acid-methyl methacrylate-N,N—dimethylacrylamide copolymer (mol ratio 10/80/10) |
| (26) | N—Acryloylglycine-ethyl methacrylate-2-hydroxyethyl methacrylate copolymer (mol ratio 10/76/14) |
| (27) | N—Acryloylglycine-methyl methacrylate-2-hydroxyethyl methacrylate copolymer (mol ratio 8/70/22) |
| (28) | N—Acryloylglycine-t-butyl- methacrylate-N,N—diethylacrylamide copolymer (mol ratio 14/80/6) |
| (29) | Itaconic acid-ethyl methacrylate-methoxymethylacrylamide copolymer (mol ratio 7/90/3) |
| (30) | N—Acryloylglycylglycine-ethyl methacrylate-2 hydroxyethyl methacrylate copolymer (mol ratio 12/72/16) |
| (31) | Methacrylic acid-ethyl methacrylate-2-hydroxyethyl methacrylate copolymer (mol ratio 10/74/16) |
| (32) | Methacrylic acid-styrene-chloromethylstyrene copolymer (mol ratio 13/60/27) |
| (33) | Methacrylic acid-acrylonitrile-butyl methacrylate copolymer (mol ratio 15/60/25) |
| (34) | Acrylic acid-i-butyl methacrylate-2-acrylamide-2-methylpropanesulfonic acid copolymer (mol ratio 7/89/4) |
| (35) | Acrylic acid-ethyl methacrylate-N—(1,1-dimethyl-3-oxobutyl)acrylamide copolymer (mol ratio 12/76/12) |

An average grain diameter of the matting agent of this invention ranges from 0.2μ to 10μ, and preferably from 1μ to 8μ.

One of advantages of the matting agent of this invention is that its average grain size is easily controlled in the process of synthesis thereof, based on the factors that the grain size increases as the molecular weight of the polymer and the amount of polymer added are increased, and decreases as the amount of wetting agent used in emulsification is increased.

In this invention, the matting agent is incorporated into the outermost layer of a sensitive material. The outermost layer may be the surface protecting layer, backing layer or both of them. However, it is particularly preferable to allow to incorporate the matting agent in the surface protecting layer.

Another advantage of the matting agent of this invention is that a dissolution tank and the like used in the process of production are washed with ease because the matting agent of this invention which is added to the coating solution for making the outermost layer does not adhere firmly to the wall surfaces of the dissolution tank and the like.

It is desirable in this invention to allow the matting agent to contain an amount of from 2 to 500 mg per square meter of the topmost layer.

In this invention, a binder to constitute the topmost layer is not restricted to particular substance. However, the use of gelatin as a binder is particularly favored.

As for gelatin, any kinds of gelatins, for example, alkali-processed gelatin, acid-processed gelatin, enzyme-processed gelatin, gelatin derivatives and denatured gelatins, are usable, and acid-processed gelatin is the best of these gelatins for purposes of this invention.

Further, the outermost layer of this invention may optionally contain a hardening agent, a smoothing agent, a surface active agent, an antistatic agent, a thickener, polymers, an ultraviolet ray absorbent, a high boiling point solvent, silver halides, a formalin capturing agent, a polymer latex and various other additives.

Examples of a hardening agent employable in this invention include aldehyde series compounds, active halogen-containing compounds such as 2-hydroxy-4,6-dichloro-1,3,5-triazine, vinyl sulfone series compounds, N-methylol series compounds, halogencarboxyaldehyde compounds such as mucochloric acid, and so on.

Examples of a smoothing agent usable in this invention include liquid paraffins, waxes, polyfluorinated hydrocarbons, silicones, and so on.

As a surface active agent, any kinds of surface active agents, for example, natural surface active agents such as saponin; nonionic surface active agents such as alkyleneoxide series ones; cationic surface active agents such as higher alkylamines, quaternary ammonium salts and so on; anionic surface active agents containing acidic groups such as carboxylic acid, sulfonic acid and so forth. Other known surface active agents can also be employed.

As an antistatic agent, the outermost layer may contain surface active agents as described above, alkali metal salts of styrene-maleic acid series copolymers and acrylonitrile-acrylic acid series copolymers, and antistatic agents as described in U.S. Pat. Nos. 3,206,312, 3,428,451 and so forth.

In addition to the matting agent having a composition represented by formula (I), previously known matting agents can be also employed in this invention. However, these known matting agents are, of course, restricted in their usable amounts to within such a range that the objects of this invention, viz., (i) that the outermost layer retains satisfactory mat properties even after the completion of development-processing, and (ii) that the matting agent is not removed by being rubbed severely with rubber lips or squeeze rollers, can be attained.

Exemplary useful known matting agents include, for example, a methyl methacrylate (MMA)-methacrylic acid (MA) (molar ratio 5/5) copolymer, MMA-MA (molar ratio range of 6/4 to 9/1) copolymers as described in U.S. Pat. No. 4,142,894; and polymethylmethacrylate (PMMA).

The matting agent PMMA suffers, as described hereinbefore, the disadvantage that it is removed by being rubbed strongly with rubber lips or squeeze rollers.

The matting agent of MMA-MA (5/5) copolymer is soluble to an alkaline developing solution, and, therefore, it cannot provide mat properties after development-processing.

The MMA-MA (6/4 to 9/1) copolymers change their properties sharply depending upon their particular compositions.

Particularly, MMA-MA (6/4 to 7/3) copolymers are soluble in commonly used alkaline developing solutions, while MMA-MA (8/2 to 9/1) copolymers do not have any solubility thereto.

Moreover, the MMA-MA (8/2 to 9/1) copolymers are not removed even by being rubbed strongly with rubber lips or the like.

Although U.S. Pat. No. 4,142,894 broadly discloses MMA-MA copolymers whose compositions extend over a range of molar ratios of from 6/4 to 9/1, only MMA-MA (6/4) copolymer is employed in the Example, and other copolymers are not referred to in the Example.

This invention is characterized by the findings that copolymers having an A-component fraction of from 0.005 to 0.20 mol/mol of polymer of the formula (I) can not be dissolved in alkaline developing solutions, and are not removed by being rubbed severely with rubber lips or the like. Accordingly, the embodiments of the present invention wherein the component A is MA and the component B is MMA represents a selective invention having unexpected properties in view of the disclosure of U.S. Pat. No. 4,142,894.

This invention does not impose any special restriction on the thickness of the outermost layer. However, it is desirable to adjust the thickness to from 0.2μ to 10μ, and particularly to 1μ to 8μ.

Embodiments of constituent layers of sensitive materials according to this invention are described below.

Silver halide emulsions can be produced in any conventional manner. For example, a single jet method, a double jet method, a controlled double jet method, an acid process, an ammonia process, or a neutral process may be used for this purpose. Silver halide grains contained in the thus produced emulsion are not restricted in their crystal form, size, and size distribution.

Silver halides which can be preferably employed herein include silver chloride, silver chlorobromide, silver iodobromide, silver chloroiodobromide, and so forth.

As a vehicle for silver halide, not only gelatin, denatured gelatins and gelatin derivatives are employed, but also carboxymethyl cellulose, hydroxyethyl cellulose, starch derivatives, polyvinyl alcohol, poly-N-pyrrolidone, acrylic acid copolymers, polyacrylamides and so on may be used in combination with the above-described gelatins. Moreover, vinyl polymers can be incorporated into photographic layers in the form of a dispersed-in-water type latex. As such latexes, homo- and copolymers of alkyl acrylates, alkyl methacrylates, acrylic acid, methacrylic acid, glycidyl acrylate, styrene, vinyl chloride, vinylidene chloride and the like may be employed.

The silver halide emulsions can be chemically sensitized in a conventional manner. The chemical sensitization can be effected using gold compounds as described in U.S. Pat. Nos. 2,399,083, 2,597,856, etc.; salts of noble metals such as platinum, palladium, rhodium and iridium; sulfur compounds, as described in U.S. Pat. Nos. 2,410,689, 3,501,313, etc.; stannous salts; amines; and so forth.

To the silver halide emulsion of this invention, various compounds can be added which are generally called stabilizers or antifoggants in this art. Specifically, not to speak of 4-hydroxy-6-methyl-1,3,3a,7-tetraazaindene, 3-methylbenzothiazole and 1-phenyl-5-mercaptotetrazole, various heterocyclic compounds, mercury-containing compounds, mercapto compounds, metal salts and so on can be used therefor.

In addition, various spectral sensitizing dyes, such as merocyanine dyes, carbocyanine dyes, cyanine dyes and the like, can be employed in the silver halide emulsions of this invention depending upon the purpose of the end-use of sensitive materials.

Color couplers which can be employed in this invention include 4-equivalent yellow couplers of diketomethylene series, 2-equivalent yellow couplers of diketomethylene series, 4- or 2-equivalent magenta couplers of pyrazolone series, indazolone series magenta couplers, α-naphthol series cyan couplers, phenyl series cyan couplers, and the so-called DIR couplers.

Furthermore, dyes, ultraviolet-ray absorbents, hardening agents as described hereinbefore, surface active agents and further, polymer latexes, and other known additives can be incorporated into the silver halide emulsion layers and other photographic layers.

As for supports for the sensitive materials of this invention, materials used conventionally in this art, such as cellulose acetate film, polyethylene terephthalate film, baryta paper, paper coated with α-olefin polymers, and so forth, can be employed.

Photographic layers of the sensitive material of this invention can be coated one layer at a time or as multilayer at a time, using a dip coating technique, an air knife coating technique, a curtain coating technique, an extrusion coating technique, or other known technique.

Selection of various additives, vehicle, a support, a coating method and so on which are to be employed in this invention can be done by reference to the description in *Research Disclosure,* Vol. 176, pp. 22–31 (Dec., 1978).

As sensitive materials which can be prepared in accordance with embodiments of this invention, mention may be made of color negative films, color reversal films, color paper, motion picture color negative films, color positive films, X-ray films, films for making printing plates, and so forth.

A light source for exposing the sensitive material thereto does not receive any restrictions in its illumination intensity and so on. Exposure is generally continued for from about 10 to $10^{-6}$ sec.

After exposure, the sensitive material of this invention is subjected to a development-processing in order to produce a silver image and/or dye image.

Any of known processes can be applied to photographic processings of the sensitive material of this invention. Therein, known processing solutions can be used. The processing temperature is commonly selected from the range of from 18° C. to 50° C. However, a temperature below 18° C. or above 50° C. may be employed as the processing temperature. Either a development-processing for producing a silver image (black-and-white photographic processing) or a color photographic processing including the development-processing for producing dye images may be applied to this invention, depending upon the purpose of the end-use of the sensitive material.

A developing solution to be employed in the case of black-and-white photographic processing can contain known developing agents. As such a developing agent, dihydroxybenzenes (e.g., hydroquinone); 3-pyrazolidones (e.g., 1-phenyl-3-pyrazolidone); aminophenols (e.g., N-methyl-p-aminophenol); 1-phenyl-3-pyrazolines; ascorbic acid; such heterocyclic compounds as to be produced by condensing a 1,2,3,4-tetrahydroquinoline ring and an indolene ring, as described in U.S. Pat. No. 4,067,872; and so on can be employed independently or in combination thereof. In addition to these developing agents, a developing solution may generally contain known preservatives, alkali agents, pH buffers and antifoggants, and further it may optionally contain dissolving aids, color toning agents, development accelerators, surface active agents, defoaming agents, water softeners, hardening agents, viscosity providing agents and so on.

To the sensitive material of this invention, the so-called "lithographic" development-processing can be applied. The term "lithographic" development-processing describes the development-processing of the kind in which development is made to proceed infectiously by the use of dihydroxybenzenes as a developing agent in the presence of a low concentration of sulfite ion with the intention of photographically reproducing line images, or half tone images utilizing half tone dots, which is described in detail in L.F.A. Mason, *Photographic Processing Chemistry,* pp. 163–165 (1966).

As a fixing solution, those compositions which have conventionally been used can be used in this invention also.

As the fixing agent, thiosulfates, thiocyanates, and organic sulfur compounds which have been known to be effective as a fixing agent can be employed.

These fixing solutions may contain water-soluble aluminum salts as a hardening agent.

Conventional methods can be applied to this invention upon the production of dye images. Namely, the negative-positive method, as described, e.g., in *Journal of the Society of Motion Picture and Television Engineers,* Vol. 61, pp. 667–701 (1953); the color reversal process, in which, to begin with, a negative silver image is produced through development using a black-and-white developing agent and then overall exposure is undertaken at least once, or another appropriate uniform fogging treatment is carried out and subsequently, color development is effected to produce positive dye image; and silver dye bleach process in which silver image is produced by the development of dye-containing photographic emulsion layers after exposure, and dyes are bleached using the resulting silver image as a bleaching catalyst; and so on can be applied.

Color developing solutions generally include alkaline aqueous solutions containing color developing agents. As color developing agents, known aromatic primary amine developers, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.), can be used.

In addition to these color developing agents, those which are described in L.F.A. Mason, *Photographic Processing Chemistry,* pp. 226–229, Focal Press (1966), U.S. Pat. Nos. 2,193,015 and 2,592,364, Japanese Patent Application (OPI) 64933/73 (the term "OPI" as used herein refers to a "published unexamined Japanese patent application"), and so forth may be also employed.

The color developing solutions may additionally contain pH buffers such as the sulfites, the carbonate and the phosphates of alkali metals; development restrainers or antifoggants such as bromides, iodides and organic antifoggants; and so on. Further, water softeners, preservatives such as hydroxyamine, organic solvents such as benzyl alcohol and diethylene glycol, development accelerators such as polyethylene glycol, quaternary ammonium salts and amines, dye forming couplers, competing couplers, fogging agents such as sodium borohydride, assistant developers such as 1-phenyl-3pyrazolidone, viscosity providing agents, chelating agents of polycarboxylic acid series as described in U.S. Pat. No. 4,083,723; antioxidants as described in German Patent Application (OLS) No. 2,622,950; and so on may be optionally contained in the color developing solutions.

After color development, the photographic emulsion layers are generally subjected to a bleaching processing. The bleaching processing may be carried out simultaneously with a fixing processing, or it may be carried out individually. Examples of bleaching agents employable in the bleaching processing include compounds of multivalent metals such as Fe(III), Co(III), Cr(IV), Cu(II), etc., peroxy acids, quinones, nitroso compounds and so on. More specifically, ferricyanides, dichromates; organic complex salts of Fe(III) or Co(III), for example, the complex salts of organic acids such as aminopolycarboxylic acids (e.g., ethylenediaminetetraacetic acid, nitrilotriacetic acid, 1,3-diamino-2-propanoltetraacetic acid, etc.), citric acid, tartaric acid, malic acid and so on; persulfates; permanganates; nitrosophenol; and so on can be used. Among these bleaching agents, potassium ferricyanide, sodium ethylenediaminetetraacetatoferrate(III), and ammonium ethylenediaminetetraacetatoferrate(III) are particularly useful. Especially, ethylenediaminetetraacetatoiron(III) complex salts are useful in both an independent bleaching solution and a combined bleaching and fixing bath.

To a bleaching solution or a combined bleaching and fixing bath, bleaching accelerators as described in U.S. Pat. Nos. 3,042,520 and 3,241,966, Japanese Patent Publications Nos. 8506/70 and 8836/70, and so on; thiol compounds as described in Japanese Patent Application (OPI) No. 65732/78, and other additives can be also added.

The sensitive materials prepared in accordance with embodiments of this invention may be processed with the developing solutions which are replenished or controlled so as to maintain their developabilities by such means as described in Japanese Patent Applications (OPI) Nos. 84636/76, 11934/77, 46732/78, 9626/79, 19741/79 and 37731/79, and Japanese Patent Applications Nos. 76159/79 and 102962/79.

Bleach-fix baths regenerated by such means as described in Japanese Patent Applications (OPI) Nos. 781/71, 49437/73, 18191/73, 145231/75, 18541/76, 19535/76 and 144620/76, and Japanese Patent Publication 23178/76 may be applied to the sensitive materials prepared in accordance with embodiments of this invention.

The present invention will now be illustrated in greater detail by reference to the following example.

EXAMPLE

Samples 1 to 10 were prepared by providing on their respective supports, which were made of a cellulose triacetate film having a subbing layer, the same red-sensitive emulsion layers, the same interlayers, the same green-sensitive emulsion layers, the same yellow filter layers, the same blue-sensitive emulsion layers and different outermost layers in order of description.

Embodiments of these layers, other than the outermost layers, are summarized in the following Table 3.

The formulae of the outermost layers are shown in the following Table 1.

TABLE 1

| | Formula of Outermost Layer | | | |
|---|---|---|---|---|
| | Matting Agent | | | |
| Sample No. | Composition | Average Diameter (μ) | Amount Coated (mg/m²) | Other Additives (common) |
| 1 | PMMA | 3.5 | 20 | Gelatin |

TABLE 1-continued

| Sample No. | Formula of Outermost Layer: Matting Agent: Composition | Average Diameter (μ) | Amount Coated ($mg/m^2$) | Other Additives (common) |
|---|---|---|---|---|
| (Comparison) 2 (Comparison) | PMMA | 3.5 | 120 | 1.0 $g/m^2$ |
| 3 (Invention) | MMA:MA = 95:5 | 3.5 | 20 | Sodium Dodecyl-benzene-sulfonate 15 $mg/m^2$ |
| 4 (Invention) | MMA:MA = 95:5 | 3.5 | 120 | |
| 5 (Invention) | MMA:MA = 90:10 | 3.5 | 20 | |
| 6 (Invention) | MMA:MA = 90:10 | 3.5 | 120 | |
| 7 (Invention) | MMA:MA = 85:15 | 3.5 | 20 | |
| 8 (Invention) | EMA:MA:AA = 87:8:5 | 3.5 | 20 | |
| 9 (Comparison) | MMA:MA = 60:40 | 3.5 | 20 | |
| 10 (Comparison) | MMA:MA = 75:25 | 3.5 | 20 | |

EMA: Ethyl Methacrylate
AA: Acrylic Acid

Each of the thus prepared samples was cut in the form of strip having a width of 35 mm and a length of about 100 m, and subjected to color development processings.

A developing solution used was that which was prepared according to the ECN-II formula (opened formula by Eastmen Kodak Co.), a developing temperature was 38° C., and the sample conveying speed was 21 m/min.

An automatic developing machine used was Pako Cine/Strip Processor Model 35-17 ECN II (produced by Pako Ltd.).

A rubber lips made of silicone rubber was arranged just behind the last processing bath. The rubber lip had such a shape that its width was 40 mm, its thickness was 8 mm, and its tip was cut at an acute angle. The rubber lips was so designed that two lips were in a tip-to-tip contact, and samples were made to pass therethrough.

After the processing of an approximately 33 m portion of each sample, the extent of removal of matting agent due to passage through the rubber lips and a mat property of the processed sample were examined, and compared with one another. The results obtained are shown in Table 2.

(i) Removal Test of Matting Agent

The extent of removal was evaluated by the number of aggregated particles adhering to the sample (35 mm wide and 30 m long), which aggregated particles were formed by the matting agent removal due to passage through the rubber lips.

| Rank | Number of Condensates Adhered to Sample |
|---|---|
| A | 0 |
| B | 5 or less |
| C | 6–25 |
| D | 26–100 |
| E | 101 or more |

(ii) Mat Property after Processings

The surface of each processed sample was observed under a microscope, and examined whether the matting agent was retained in its original form (the same form as it had before development processing) or not; whether the matting agent was dissolved away or not; and whether the matting agent was deformed or not.

As can be seen from Table 2, the samples 3 to 8 prepared in accordance with embodiments of this invention did not show removal of their respective matting agents, and retained good mat property even after the completion of development-processing.

On the other hand, in each of samples 1 and 2 where PMMA was employed as the matting agent, the matting agent was removed by the rubber lips and adhered again to other parts of the sample. Therefore, the quality of the processed material was spoiled to a great extent.

In addition, in the cases of the samples 9 and 10 where the MMA-MA (60:40) copolymer and the MMA-MA (75:25) copolymer were employed respectively, whole or a large portion of the matting agent was dissolved into the processing solution. Consequently, the processed materials lost their original mat properties completely.

TABLE 2

| Sample No. | Removal Test | Mat Property after Processings |
|---|---|---|
| 1 (Comparison) | D | Each grains in the aggregated particles*1 retained their original form |
| 2 (Comparison) | E | Each grains in the aggregated particles*1 retained their original form |
| 3 (Invention) | A | Grains are present as they were initially. |
| 4 (Invention) | A | Grains are present as they were initially. |
| 5 (Invention) | A | Grains are present as they were initially. |
| 6 (Invention) | A | Grains are present as they were initially. |
| 7 (Invention) | A | Grains are present as they were initially. |
| 8 (Invention) | A | Grains are present as they were initially. |
| 9 (Comparison) | A*2 | Almost all grains were removed. |
| 10 | A*2 | A small number of deformed |

TABLE 2-continued

| Sample No. | Removal Test | Mat Property after Processings |
|---|---|---|
| (Comparison) | | grains remained. |

*1Matting agent was removed by the rubber lips and the removed matting agent grains were aggregated to form aggregated particles and, the aggregated particles adhered again to other parts of the sample.

*2whole or a large portion of the matting agent was dissolved into the processing solution and, therefore, no adhered aggregated particle was observed.

TABLE 3

| | Red-Sensitive Emulsion Layer | Green-Sensitive Emulsion Layer | Blue-Sensitive Emulsion Layer | Interlayer | Yellow Filter Layer |
|---|---|---|---|---|---|
| Color Forming Agent | 4-Chloro-1-hydroxy-N—dodecyl-2-naphthamide 0.88 g/m$^2$ | 1-(2,4,6-Trichlorophenyl)-3-[3-(2,4-di-t-amylphenoxy)-acetamido]benzamido-5-pyrazolone 0.75 g/m$^2$ | 3'-(2,4-Di-t-amylphenoxyacetamido)-α-(4-methoxybenzoyl)-acetanilide 1.31 g/m$^2$ | — | — |
| Spectral Sensitizer | Bis(9-ethyl-5-phenyl-Bis(9-ethyl-5-chloro-3-β-hydroxyethyl)thiacarbocyanine Bromide 6.51 mg/m$^2$ | — 3-ethyl)oxycarbocyanine Isothiocyanate 5.23 mg/m$^2$ | — | — | |
| Stabilizer | 5-Hydroxy-7-methyl-1,3,8-triazaindolidine 8.19 mg/m$^2$ | The same as at the left 7.71 mg/m$^2$ | The same as at the left 6.50 mg/m$^2$ | — | — |
| Hardener | 2,4-Dichloro-6-hydroxy-1,3,5-triazine Sodium Salt 15 mg/m$^2$ | The same as at the left 14 mg/m$^2$ | The same as at the left 20 mg/m$^2$ | The same as at the left 10 mg/m$^2$ | The same as at the left 11 mg/m$^2$ |
| Coating Aids | Sodium p-Dodecylbenzenesulfonate 42 mg/m$^2$ | The same as at the left 51 mg/m$^2$ | The same as at the left 67 mg/m$^2$ | The same as at the left 56 mg/m$^2$ | The same as at the left 63 mg/m$^3$ |
| | Sodium p-Nonylphenoxypoly-ethyleneoxy)-propanesulfonate 53 mg/m$^2$ | The same as at the left 64 mg/m$^2$ 64 mg/m$^2$ | The same as at the left 84 mg/m$^2$ 84 mg/m$^2$ | The same as at the left 71 mg/m$^2$ 71 mg/m$^2$ | The same as at the left 80 mg/m$^2$ 80 mg/m$^2$ |
| | Silver iodobromide emulsion (silver iodide content: 5.5 mol %) | | | — | Yellow colloidal silver |
| Dry | 5μ | 6μ | 5μ | 2μ | 2μ |

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material which has on a support at least one light-sensitive silver halide emulsion layer, said material containing in its outermost layer at least one kind of alkali-insoluble synthetic polymer grains having a glass transition point of at least 60° C. and an average grain size of from 0.2μ to 10μ, and said polymer is represented by formula (I)

$$-A)_x(B)_y(C)_z \quad (I)$$

wherein A represents a divalent group derived from at least one monomer having the formula (II); B represents a divalent group derived from at least one monomer having the formula (III), whose homopolymer has a glass transition point of at least 50° C.; C represents a divalent group derived from an ethylenic unsaturated monomer other than A or B which is capable of copolymerizing with the monomers forming both A and B, said divalent group being derived from a member selected from the group consisting of methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octylacrylate, tert-octyl acrylate, 4-chlorobutyl acrylate, cyanoethyl acrylate, dimethylaminoethyl acrylate, cyclohexyl acrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethylene glycol monoacrylate, triethylene glycol monoacrylate, dipropylene glycol monoacrylate, glycerol monoacrylate, trimethylolethane monoacrylate, trimethylolpropane monoacrylate, pentaerythritol monoacrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate wherein the addition mol number of ethylene oxide groups is 9, ω-lauroxypolyethylene glycol acrylate wherein the addition mol number of ethylene oxide groups is 20, 1-bromo-2-methoxyethyl acrylate, 1,1-dichloro-2-ethoxyethyl acrylate, 2-hydroxy-3-chloropropyl acrylate, amyl methacrylate, hexyl methacrylate, octyl methacrylate, sulfopropyl methacrylate, N,N-diethylaminopropyl methacrylate, 2-hydroxyethyl methacrylate, 3-hydroxypropyl methacrylate, 2-hydroxypropyl methacrylate, 2,3-dihydroxypropyl methacrylate, 4-hydroxybutyl methacrylate, 5-hydroxypentyl methacrylate, 2,2-dimethyl-3-hydroxypropyl methacrylate, diethylene glycol monomethacrylate, triethylene glycol monomethacrylate, dipropylene glycol monomethacrylate, glycerol monomethacrylate, trimethylolethane monomethacrylate, trimethylolpropane monomethacrylate, pentaerythritol monomethacrylate, 2-methoxyethyl methacrylate, 3-methoxybutyl methacrylate, 2-ethoxythyl methacrylate, 2-isopropoxyethyl methacrylate, 2-butoxyethyl methacrylate, 2-(2-methoxyethoxy) ethyl methacrylate, 2-(2-ethoxyethoxy)ethyl methacrylate, 2-(2-butoxyethoxy)ethyl methacrylate, ω-methoxypolyethylene glycol methacrylate wherein the addition mol number of ethylene oxide groups is 6, ω-methoxypolyethylene glycol methacrylate wherein the addition mol number of ethylene oxide groups is 23, ω-lauroxypolyethylene glycol methacrylate, hexyl acrylamide, octyl acrylamide, 2-acrylamido-2-methylpropane-sulfonic acid, N-(1,1-dimethyl-3-oxobutyl)acrylamide, pentyl methacrylamide, dihexyl methacrylamide, allyl caproate, allyl caprate, allyl laurate, allyl palmitate, allyl stearate, allyl acetoacetate, allyl butyrate, allyloxyethanol, allyl butyl ether, hexyl vinyl ether, octyl vinyl ether, decyl vinyl ether, ethylhexyl vinyl ether, methoxyethyl vinyl ether, ethoxyethyl vinyl ether, 2-ethylbutyl vinyl ether, hydroxyethyl vinyl ether, diethylene glycol vinyl ether, dimethylaminoethyl vinyl ether, vinyl formate, vinyl acetate, vinyl propionate, vinyl butyrate, vinyl isobutyrate, vinylethyl butyrate, vinyl valerate, vinyl caproate, vinyl methoxyacetate, vinyl butoxyacetate, vinyl acetoacetate, vinyl lactate, N-vinyloxazolidone, vinylpyridine, vinylpicoline, N-vinylimidazole, N-vinyl-2-methylimidazole, N-vinyl-triazole, N-vinyl-3,5-dimethyltriazole, N-vinyl, pyrrolidone, N-vinyl-3,5-dimethylpyrazole, N-vinylcarbazole, vinylthiophene, N-vinylsuccinimide, N-vinylglutarimide, N-vinylaldipimide, N-methyl-N-vinylformamide, N-ethyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-s-caprolactam, N-vinyl-2-pyridone, vinyl methyl ketone, methoxyethyl vinyl ketone, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,5,6-trimethyl-1-heptene, 1-dodecene, 1-octadecene, dioctyl itaconate, dihexyl itaconate, dibutyl itaconate, maleic anhydride, dihexyl maleate, butyl hexyl maleate, dibutyl maleate, dioctyl maleate, dibutyl fumarate, and dioctyl fumarate; x represents the fractional content of group A, which ranges from 0.03 to less than 0.1 mol/mol of polymer of formula (I); y represents the fractional content of group B, which ranges from 0.50 to 0.97 mol/mol of polymer of formula (I); and z represents the fractional content of group C, which ranges from 0 to 0.47 mol/mol of polymer of formula (I), and formula (II) is represented by

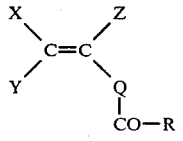

(II)

wherein X, Y and Z each represents hydrogen, an alkyl group having from 1 to 6 carbon atoms, —COR, or —$COOR_1$; Q represents

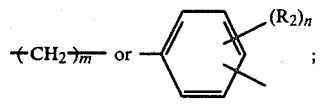

and R represents

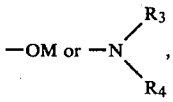

where $R_1$ represents a substituted or an unsubstituted alkyl group having from 1 to 18 carbon atoms, an aryl group having from 6 to 18 carbon atoms, or an aralkyl group having from 7 to 12 carbon atoms; $R_2$ represents hydrogen, a halogen atom, an alkyl group having from 1 to 12 carbon atoms or an alkoxy group having from 1 to 6 carbon atoms; $R_3$ represents hydrogen, a substituted or an unsubstituted alkyl group having from 1 to 4 carbon atoms, a phenyl group or an aralkyl group having from 7 to 10 carbon atoms; $R_4$ represents the same groups as $R_3$ or an —$R_5$—CONH)$_l$$R_5$—$COR_7$ group, wherein $R_5$ represents a divalent aliphatic or an aromatic group ($C_1$–$C_{12}$), $R_7$ represents —OM, hydrogen, a substituted or an unsubstituted alkyl group ($C_1$–$C_4$), a phenyl group or an aralkyl group ($C_7$–$C_{10}$), and l is an integer of 0 to 6; M represents hydrogen or a cation; m is 0 or 1; and n is an integer of from 1 to 4; and formula (III) is represented by

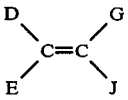

(III)

wherein D and E each represents hydrogen, a methyl group, a halogen atom, or —$COOR_6$; G represents hydrogen, a methyl group, a halogen atom or —$(CH_2)_k$—$COOR_6$; J represents hydrogen, an aryl group,

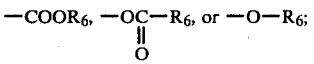

$R_6$ represents a substituted or an unsubstituted alkyl group having from 1 to 10 carbon atoms, an aryl group having from 6 to 12 carbon atoms, or an aralkyl group having from 7 to 12 carbon atoms; and k is 0 or 1.

2. A silver halide photographic light-sensitive material as in claim 1, wherein said divalent group A is represented by the formula (II) wherein X, Y and Z each is hydrogen, and a is —COR, $)_m$—.

3. A silver halide photographic light-sensitive material as in claim 1, wherein said formula (II) represents acrylic acid, methacrylic acid, maleic acid, itaconic acid or acryloylamino acid.

4. A silver halide photographic light-sensitive material as in claim 3, wherein said formula (II) represents acrylic acid or methacrylic acid.

5. A silver halide photographic light-sensitive material as in claim 1, wherein said monomer B is represented by the formula (III) wherein D and E each is hydrogen and G is a methyl group.

6. A silver halide photographic light-sensitive material as in claim 1, wherein said formula (III) represents a methacrylic acid ester or a styrene.

7. A silver halide photographic light-sensitive material as in claim 1, wherein said formula (II) represents acrylic acid or methacrylic acid, and said formula (III) represents a methacrylic acid ester or a styrene.

8. A silver halide photographic light-sensitive material as in claim 7, wherein z in said formula (I) is zero.

9. A silver halide photographic light-sensitive material as in claim 1, 2, 3, 4, 5, 6, 7, or 8, wherein said outermost layer is a surface protecting layer, and said polymer grains are coated in an amount of from 2 to 500 mg per square meter.

10. A silver halide photographic light-sensitive material as in claim 1, 2, 3, 4, 5, 6, 7, or 8, wherein the average grain diameter of the polymeric grains is from 1μ to 8μ.

11. A method for forming photographic images comprising imagewise exposing and development-processing a silver halide photographic sensitive material wherein during said development-processing excess liquid is removed from the film material surface by squeezing means, wherein said silver halide photographic light-sensitive material has on a support at least one light-sensitive silver halide emulsion layer, said material containing in its outermost layer at least one kind of alkali insoluble synthetic polymer grains having a glass transition point of at least 60° C. and an average grain size of from 0.2μ to 10μ, and said polymer is represented by formula (I)

$$-A)_x(B)_y(C)_z \qquad (I)$$

wherein A represents a divalent group derived from at least one monomer having the formula (II); B represents a divalent group derived from at least one monomer having the formula (III), whose homopolymer has a glass transition point of at least 50° C.; C represents a divalent group derived from an ethylenic unsaturated monomer other than A or B which is capable of copolymerizing with the monomers forming both A and B, said divalent group being derived from a member selected from the group consisting of methyl acrylate, ethyl acrylate, n-propyl acrylate, isopropyl acrylate, n-butyl acrylate, isobutyl acrylate, sec-butyl acrylate, amyl acrylate, hexyl acrylate, 2-ethylhexyl acrylate, octylacrylate, tert-octyl acrylate, 4-chlorobutyl acrylate, cyanoethyl acrylate, dimethylaminoethyl acrylate, cyclohexyl acrylate, 2-hydroxyethyl acrylate, 3-hydroxypropyl acrylate, 2-hydroxypropyl acrylate, 2,3-dihydroxypropyl acrylate, 4-hydroxybutyl acrylate, 5-hydroxypentyl acrylate, 2,2-dimethyl-3-hydroxypropyl acrylate, diethylene glycol monoacrylate, triethylene glycol monoacrylate, dipropylene glycol monoacrylate, glycerol monoacrylate, trimethylolethane monoacrylate, trimethylolpropane monoacrylate, pentaerythritol monoacrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyl acrylate, ω-methoxypolyethylene glycol acrylate wherein the addition mol number of ethylene oxide groups is 9, ω-lauroxypolyethylene glycol acrylate wherein the addition mol number of ethylene oxide groups is 20, 1-bromo-2-methoxyethyl acrylate, 1,1-dichloro-2-ethoxyethyl acrylate, 2-hydroxy-3-chloropropyl acrylate, amyl methacrylate, hexyl methacrylate, octyl methacrylate, sulfopropyl methacrylate, N,N-diethylaminopropyl methacrylate, 2-hydroxyethyl methacrylate, 3-hydroxypropyl methacrylate, 2-hydroxypropyl methacrylate, 2,3-dihydroxypropyl methacrylate, 4-hydroxybutyl methacrylate, 5-hydroxypentyl methacrylate, 2,2-dimethyl-3-hydroxypropyl methacrylate, diethylene glycol monomethacrylate, triethylene glycol monomethacrylate, dipropylene glycol monomethacrylate, glycerol monomethacrylate, trimethylolethane monomethacrylate, trimethylolpropane monomethacrylate, pentaerythritol monomethacrylate, 2-methoxyethyl methacrylate, 3-methoxybutyl methacrylate, 2-ethoxythyl methacrylate, 2-isopropoxyethyl methacrylate, 2-butoxyethyl methacrylate, 2-(2-methoxyethoxy) ethyl methacrylate, 2-(2-ethoxyethoxy)ethyl methacrylate, 2-(2-butoxyethoxy)ethyl methacrylate, ω-methoxypolyethylene glycol methacrylate wherein the addition mol number of ethylene oxide groups is 6, ω-methoxypolyethylene glycol methacrylate wherein the addition mol number of ethylene oxide groups is 23, ω-lauroxypolyethylene glycol methacrylate wherein the addition mol number of ethylene oxide groups is 20, hexyl acrylamide, octyl acrylamide, 2-acrylamido-2-methylpropanesulfonic acid, N-(1,1-dimethyl-3-oxobutyl)acrylamide, pentyl methacrylamide, dihexyl methacrylamide, allyl caproate, allyl caprate, allyl laurate, allyl palmitate, allyl stearate, allyl acetoacetate, allyl butyrate, allyloxyethanol, allyl butyl ether, hexyl vinyl ether, octyl vinyl ether, decyl vinyl ether, ethylhexyl vinyl ether, methoxyethyl vinyl ether, ethoxyethyl vinyl ether, 2-ethylbutyl vinyl ether, hydroxyethyl vinyl ether, diethylene glycol vinyl ether, dimethylaminoethyl vinyl ether, vinyl formate, vinyl acetate, vinyl propionate, vinyl butyrate, vinyl isobutyrate, vinylethyl butyrate, vinyl valerate, vinyl caproate, vinyl methoxyacetate, vinyl butoxyacetate, vinyl acetoacetate, vinyl lactate, N-vinyloxazolidone, vinylpyridine, vinylpicoline, N-vinylimidazole, N-vinyl-2-methylimidazole, N-vinyl-triazole, N-vinyl-3,5-dimethyltriazole, N-vinyl, pyrrolidone, N-vinyl-3,5-dimethylpyrazole, N-vinylcarbazole, vinylthiophene, N-vinylsuccinimide, N-vinylglutarimide, N-vinyladipimide, N-methyl-N-vinylformamide, N-ethyl-N-vinylformamide, N-methyl-N-vinylacetamide, N-ethyl-N-vinylacetamide, N-methyl-N-vinylpropionamide, N-vinylpyrrolidone, N-vinylpiperidone, N-vinyl-s-caprolactam, N-vinyl-2-pyridone, vinyl methyl ketone, methoxyethyl vinyl ketone, ethylene, propylene, 1-butene, 1-pentene, 1-hexene, 4-methyl-1-pentene, 1-heptene, 1-octene, 1-decene, 5-methyl-1-nonene, 5,5-dimethyl-1-octene, 4-methyl-1-hexene, 4,4-dimethyl-1-pentene, 5-methyl-1-hexene, 4-methyl-1-heptene, 5-methyl-1-heptene, 4,4-dimethyl-1-hexene, 5,5,6-trimethyl-1-heptene, 1-dodecene, 1-octadecene, dioctyl itaconate, dihexyl itaconate, dibutyl itaconate, maleic anhydride, dihexyl maleate, butyl hexyl maleate, dibutyl maleate, dioctyl maleate, dibutyl fumarate, and dioctyl fumarate; x represents the fractional content of group A, which ranges from 0.03 to less than 0.1 mol/mol of polymer of formula (I); y represents the fractional content of group B, which ranges from 0.50 to 0.97 mol/mol of polymer of formula (I); and z represents the fractional content of group C, which ranges from 0 to 0.47 mol/mol of polymer of formula (I), and formula (II) is represented by

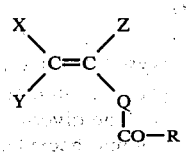

(II)

wherein X, Y and Z each represents hydrogen, an alkyl group having from 1 to 6 carbon atoms, —COR, or —$COOR_1$; Q represents

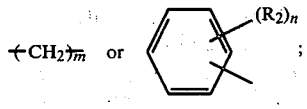

and R represents

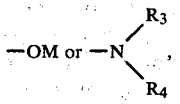

where $R_1$ represents a substituted or an unsubstituted alkyl group having from 1 to 18 carbon atoms, an aryl group having from 6 to 18 carbon atoms, or an aralkyl group having from 7 to 12 carbon atoms; $R_2$ represents hydrogen, a halogen atom, an alkyl group having from 1 to 12 carbon atoms or an alkoxy group having from 1 to 6 carbon atoms; $R_3$ represents hydrogen, a substituted or an unsubstituted alkyl group having from 1 to 4 carbon atoms, a phenyl group or an aralkyl group having from 7 to 10 carbon atoms; $R_4$ represents the same groups as $R_3$ or an —$R_5$—CONH)$_l$$R_5$—$COR_7$ group, wherein $R_5$ represents a divalent alphatic or an aromatic group ($C_1$–$C_{12}$), $R_7$ represents —OM, hydrogen, a substituted or an unsubstituted alkyl group ($C_1$–$C_4$), a phenyl group or an aralkyl group ($C_7$–$C_{10}$) and l is an integer of 0 to 6; M represents hydrogen or a cation; m is 0 or 1; and n is an integer of 1 to 4; and formula (III) is represented by

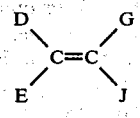

(III)

wherein D and E each represents hydrogen, a methyl group, a halogen atom, or —$COOR_6$; G represents hydrogen, a methyl group, a halogen atom or —$(CH_2)_k$—$COOR_6$; J represents hydrogen, an aryl group,

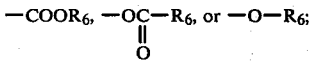

$R_6$ represents a substituted or an unsubstituted alkyl group having from 1 to 10 carbon atoms, an aryl group having from 6 to 12 carbon atoms, or an aralkyl group having from 7 to 12 carbon atoms; and k is 0 or 1.

12. A method as in claim 11, wherein said divalent group A is represented by the formula (II) wherein X, Y and Z each is hydrogen, a methyl group or —COR, and Q is —$(CH_2)_m$—.

13. A method as in claim 11, wherein said formula (II) represents acrylic acid, methacrylic acid, maleic acid, itaconic acid or acryloylamino acid.

14. A method as in claim 11, wherein said formula (II) represents acrylic acid or methacrylic acid.

15. A method as in claim 11, wherein said divalent group B is represented by the formula (III) wherein D and E each is hydrogen and G is a methyl group.

16. A method as in claim 11, wherein said formula (III) represents a methacrylic acid ester or a styrene.

17. A method as in claim 11, wherein said formula (II) represents acrylic acid or methacrylic acid, and said formula (III) represents a methacrylic acid ester or a styrene.

18. A method as in claim 17, wherein z in said formula (I) is zero.

19. A method as in claim 11, 12, 13, 14, 15, 16, 17, or 18, wherein said outermost layer is a surface protecting layer, and said polymer grains are coated in an amount of from 2 to 500 mg per square meter.

20. A method as in claim 11, 12, 13, 14, 15, 16, 17, or 18, wherein the average grain diameter of the polymeric grains is from 1μ to 8μ.

21. A method as in claim 11, wherein said squeezing means is a rubber lips, squeeze rollers or buff rollers.

* * * * *